US005358923A

United States Patent [19]

Mitsuhata et al.

[11] Patent Number: 5,358,923

[45] Date of Patent: Oct. 25, 1994

[54] COLOR SHEET AND COLOR TRANSFER METHOD USING THE SAME

[75] Inventors: Takanori Mitsuhata; Fumio Matsui, both of Tsurugashima, Japan

[73] Assignee: Pioneer Electronic Corporation, Tokyo, Japan

[21] Appl. No.: 88,548

[22] Filed: Jul. 9, 1993

[30] Foreign Application Priority Data

Jul. 10, 1992 [JP] Japan ..... 4-183673

[51] Int. Cl.[5] ..... B41M 5/035; B41M 5/38

[52] U.S. Cl. ..... 503/227; 428/195; 428/913; 428/914; 430/200; 430/201; 430/945

[58] Field of Search ..... 428/195, 913, 914; 430/200, 945, 201; 503/227

[56] References Cited

U.S. PATENT DOCUMENTS 5,219,703 6/1993 Bugner et al. ..... 430/200
5,232,817 8/1993 Kawakami et al. ..... 430/201
5,246,909 9/1993 Thien et al. ..... 503/227

FOREIGN PATENT DOCUMENTS 2083726 3/1982 United Kingdom ..... 503/227

*Primary Examiner*—B. Hamilton Hess
*Attorney, Agent, or Firm*—Keck, Mahin & Cate

[57] ABSTRACT

A color sheet comprising; a flexible substrate or film; and a dye layer formed on the substrate including a sublimating dye of yellow, magenta or cyan and a near infrared absorbing pigment with a near infrared absorption without a substantial visible absorption.

A color transfer method comprises the steps of: preparing a color sheet above mentioned; abutting the dye layer of the color sheet onto an image receiving sheet to be printed; and irradiating an optical laser beam to the dye layer, the laser beam having a wavelength in the near infrared region absorbed by the near infrared absorbing pigment, whereby a light energy absorbed by the near infrared absorbing pigment is converted into a heat energy thereby sublimating the sublimating dye and transferring the sublimated dye onto the image receiving sheet arranged so as to face the dye layer.

As a result, a recording speed and a resolution are remarkably improved with the color sheet and the color transfer method using it.

10 Claims, 6 Drawing Sheets

COLOR SHEET AND COLOR TRANSFER METHOD USING THE SAME

BACKGROUND OF THE INVENTION

1. Field of the Invention

The present invention concerns a color sheet of a sublimating type and a color transfer method using such a sheet and, more particularly, relates to a color sheet of a sublimating type in which a degree of clearness of the printing is improved and a required time for printing is shortened and a color transfer method using the same.

2. Description of the Related Art

Generally, there is known a sublimation thermal transfer method as one of printing methods capable of making excellent gradations which is frequently used in a full color printer of a thermo-sensitive type or a video printer. As shown in FIG. 1, the sublimation thermal transfer method above method is based on the following principle. That is, a color sheet 100 is prepared which comprising a heat resistant lubricating layer 101 on one side of the substrate 102 and a dye layer 103 is coated on the other side of the substrate. The dye layer 103 contains a sublimating solid ink of yellow, cyan or magenta which is solid at room temperature. The dye layer 103 is heated and sublimated by a thermal head 105 contacted with the lubricating layer 101. The sublimated dye is diffused and fixed into a receptor layer 121 on an image receiving base plate 120 of a paper contacting with the dye layer, thereby forming an image on the paper.

In the conventional method utilizing the thermal head, there are problems of the facts that not only a sublimation point of the dye is so high to lie within a range from 130° to 200° C., but also a thermal speed of response of the thermal head 105 is low. In order to heat and sublimate the dye in the dye layer 103 through both the lubricating layer 101 and the substrate 102 and to transfer the sublimated dye to the receptor layer 121, there are consequently problems such that the thermal head must be slowly moved with respect to the thermal transfer medium of the paper while applying a fairly large amount of heat energy to the latter, so that a recording speed becomes extremely slow.

Furthermore, in the case of using the conventional thermal head method, the periphery of one fine dot is influenced by the heat diffusion and then a blur of the formed image occurs. There is inherently a limitation to obtain a clear image as a result, i.e., the resolution doesn't exceed a certain limit value, even if a thermal head having very small heat generating elements will be manufactured in order to form the very fine recording dots.

SUMMARY OF THE INVENTION

It is an object of the present invention to provide a color sheet in which a recording speed and a resolution are remarkably improved and a color transfer method using such a sheet.

According to a first aspect of the present invention, there is provided a color sheet comprising; a flexible substrate or film; and a dye layer formed on said substrate including a sublimating dye of yellow, magenta or cyan and a near infrared absorbing pigment which exhibits a light absorption property for a near infrared region without exhibiting a substantial light absorption property for a visible wavelength region.

According to a second aspect of the present invention, there is provided a color transfer method comprises the steps of:

preparing a color sheet comprising; a flexible substrate or film; and a dye layer formed on said substrate including a sublimating dye of yellow, magenta or cyan and a near infrared absorbing pigment which exhibits a light absorption property for a near infrared region without exhibiting a substantial light absorption property for a visible wavelength region;

abutting said dye layer of said color sheet onto an image receiving sheet to be printed; and irradiating an optical laser beam to said dye layer, the laser beam having a wavelength in the near infrared region absorbed by said near infrared absorbing pigment, whereby a light energy absorbed by said near infrared absorbing pigment is converted into a heat energy thereby sublimating said sublimating dye and transferring the sublimated dye onto said image receiving sheet arranged so as to face the dye layer.

Since the near infrared absorbing pigment is contained in the dye layer of the color sheet of the present invention, for example, when an optical laser beam having a wavelength in a near infrared region of 780 to 830 nm is irradiated to the dye layer, the near infrared absorbing pigment absorbs the light energy and converts into the heat energy. The sublimating dye is sublimated by the heat energy and is transferred onto the paper on which an image is to be printed and arranged so as to face the dye later.

DESCRIPTION OF THE PREFERRED EMBODIMENT

Figure 1:
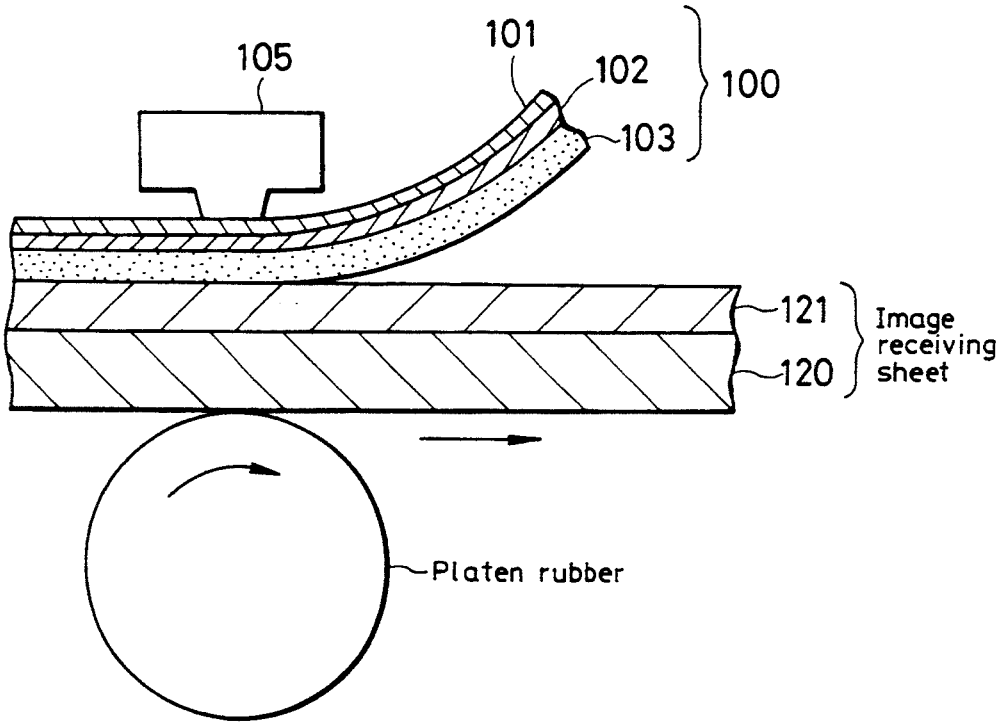
FIG. 1 is a cross sectional view showing schematically a conventional transfer method.
Figure 2:
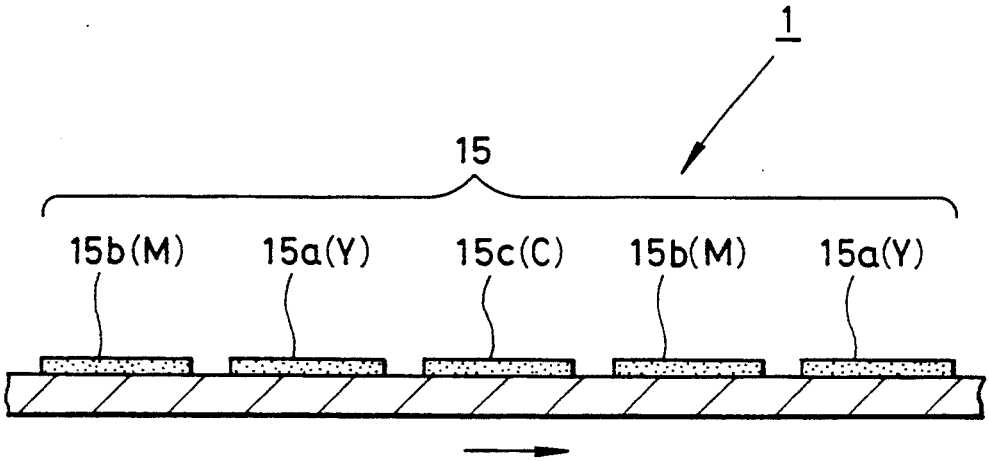
FIG. 2 is a schematic cross sectional view of a color sheet of the present invention comprising dye layers of three color areas which are sequentially arranged with equal intervals as an area sequential type.
Figure 3:
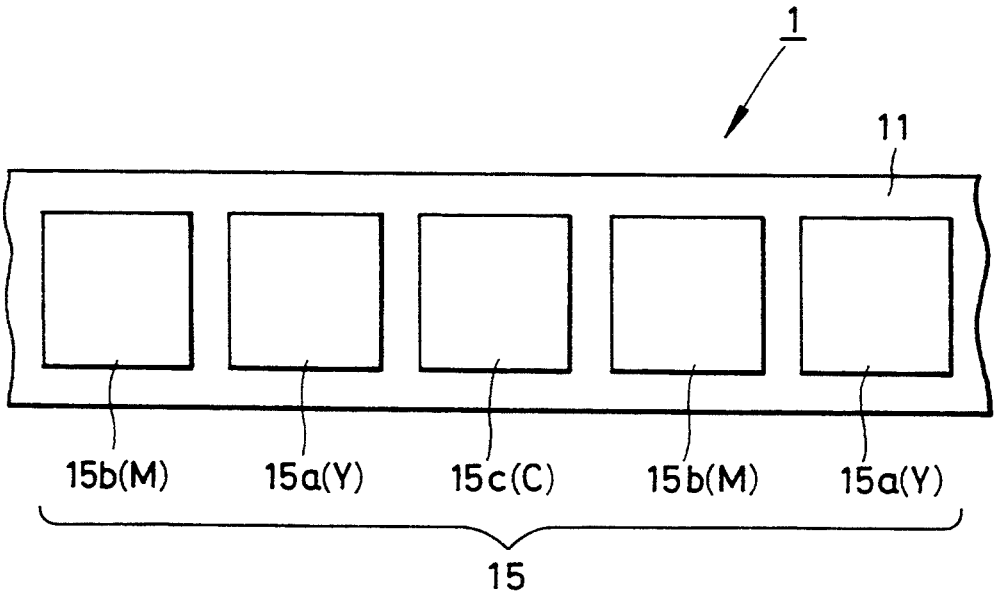
FIG. 3 is a plan view of the color sheet shown in FIG. 1.
Figure 4:
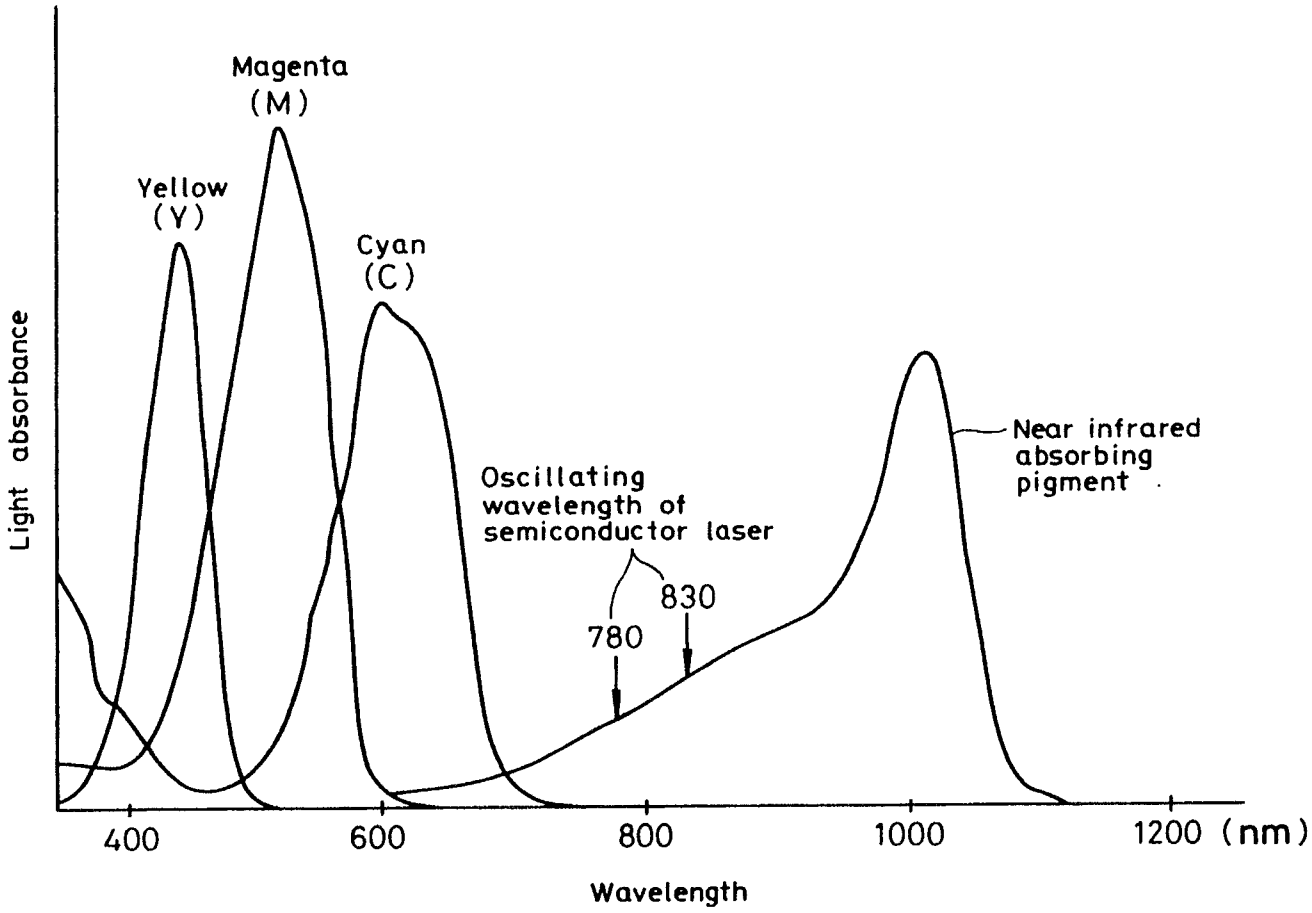
FIG. 4 is a graph showing a relationship of the light absorption distributions with respect to wavelength between a near infrared absorbing pigment and the sublimating dyes of yellow, magenta and cyan.
Figure 5:
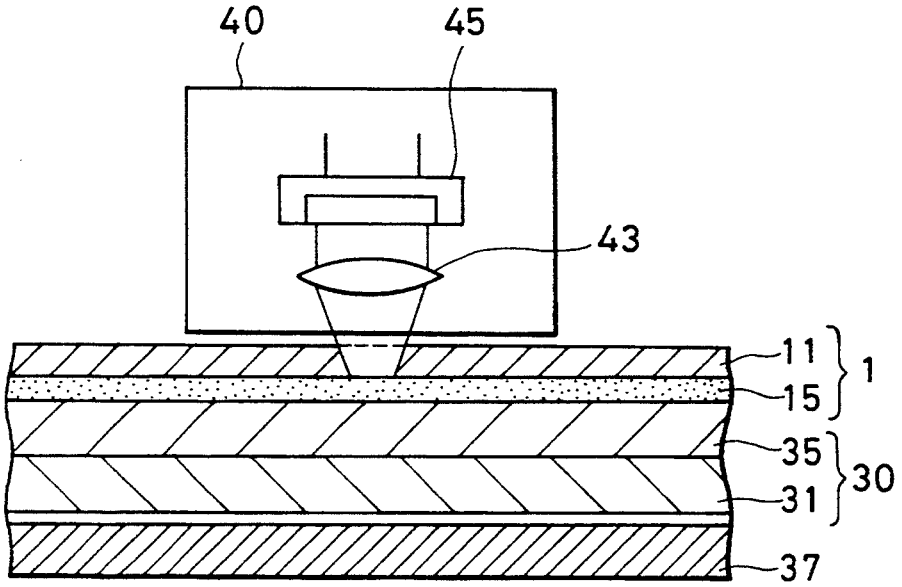
FIG. 5 is a cross sectional view showing schematically a transfer method according to the present invention in which the dye of a color sheet is transferred onto a paper on which an image is to be printed.

A color sheet 1 of the present invention will be described with reference to FIGS. 2 to 5. FIGS. 2 and 3 are a schematic cross sectional view and a plan view of the color sheet 1 having dye layers of three area sequential types as an example, respectively. FIG. 4 is a graph showing the relationship of the light absorbance distributions among the dyes and pigments contained in the dye layer. FIG. 5 is a cross sectional view showing schematically a state in which the dye of the color sheet is transferred onto a paper 30 on which an image is to be printed.

As shown in FIGS. 2 and 3, the color sheet 1 of the present invention has a flexible substrate or film 11 and a plurality of dye layers 15 coated on the substrate 11.

As for a substrate 11 is made of a resin martial having a good light transmittance which is not colored by the dye, for example, polyester resin such as polyethylene, terephthalate or the like. In the present invention, there is no need to strictly select the material of the substrate in consideration to a heat transmittance property as compared with the case of using the conventional thermal head, because the recording or printing is executed by using the light energy. From such a standpoint, an arbitrary resin can be widely selected for the substrate and there is also no need to make a thickness of the film thin. A thickness of the substrate may be generally set to about a few μm. The dye layers 15 coated onto the substrate 11 comprises at least three color areas e.g. dye layers 15*a* (Y: yellow), 15*b* (M: magenta) and 15*c* (C: cyan) which are sequentially arranged with equal intervals, this arrangement so-called area sequential type.

The dye layers 15*a* (Y), 15*b* (M), and 15*c* (C) contains sublimating dyes corresponding to the respective color areas and the near infrared absorbing pigment respectively.

The preferred examples of the sublimating dyes corresponding to color areas as follows:

A sublimating dye of yellow represented by

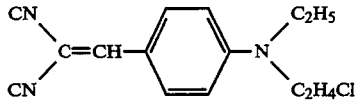

or

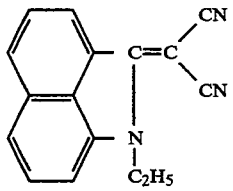

is contained in the die layer 15*a;*

A sublimating dye of magenta represented by

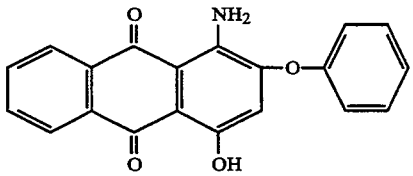

or

-continued

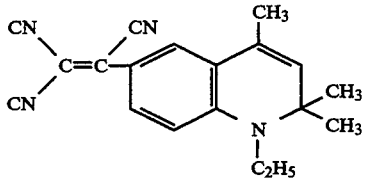

is contained in the dye layer 15*b*; and

A sublimating dye of cyan represented by

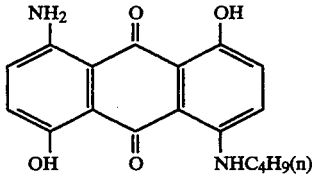

or

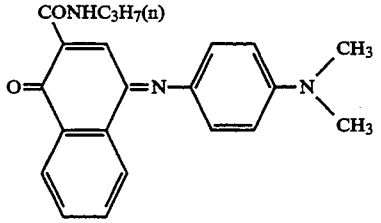

is contained in the dye layer 15*c*.

As such sublimating dyes, each dye of about 2 to 10 weight parts is contained in the ink composition before the dye layer is coated.

The near infrared absorbing pigment is contained in each of the dye layers 15*a*, 15*b* and 15*c* containing such sublimating dyes. The near infrared absorbing pigment mainly denotes a pigment which exhibits light absorption property for the near infrared region in a range of wavelengths of 760 to 2500 nm but doesn't exhibit the substantial light absorption property for the visible wavelength region in a range of wavelengths of 380 to 780 nm. The reason why the near infrared absorbing pigment needs to exhibits the light absorption property for the near infrared region is to effectively use a semiconductor laser having an oscillating wavelength in a range of 780 to 830 nm which has at present been put into practical use by a high power as recording means. The reason why the pigment doesn't have the light absorption property for the visible wavelength region is to prevent the color inks of dyes from blurring each other. In spite of the fact that the pigment doesn't exhibit the light absorption property for the visible wavelength region, there is also a case where an edge portion of the distribution of the light absorbance slightly enters the visible wavelength region. In such a case, no problem occurs so long as such a state lies within a range in such a manner that no color stain occurs, namely, an intensity of the absorbance is relatively small. In this meaning, a term "substantial" is used.

As an example of the near infrared absorbing pigment, there is a pigment having the following structure formula:

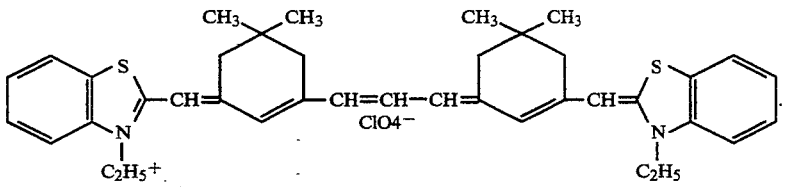

As such a near infrared absorbing pigment, a pigment of 2 to 20 weight parts, more preferably, 2 to 10 weight parts is contained in the ink composition before the dye layer is coated. When the value of the weight parts of the pigment contained in the ink composition exceeds 20 weight parts, there occurs an inconvenience in such a manner that the color of the near infrared absorbing pigment itself exerts an influence on the color of an image that have been formed after the dye have been transferred. When such a containing value is less than 2 weight parts, an amount of heat energy which is converted from the light energy by the near infrared absorbing pigment decreases, so that there occurs an inconvenience such that it becomes hard to cause a sublimation of the dye.

FIG. 4 is a graph showing the relationship between the light absorbance distribution of such a near infrared absorbing pigment and the light absorbance distribution of each of the sublimating dyes of yellow (Y), magenta (M), and cyan (C). According to the graph of FIG. 4, each sublimating dye doesn't exhibit the light absorption property for the region of the laser oscillating wavelengths, although the near infrared absorbing pigment exhibits the light absorption property in a region of laser oscillating wavelengths of 780 to 830 nm. The near infrared absorbing pigment, further, doesn't exhibit the substantial light absorption property for the visible wavelength region in a range of wavelengths of 380 to 780 nm. The edge portion of the light absorbance distribution lies within a range such that no color stain occurs, although the edge portion of distribution slightly exists in the visible wavelength region.

In addition, a binder resin such as celluloses, water soluble acryls, polyvinyl alcohol, polyamides or the like may be contained in the ink composition before the dye layer is coated. Methylethyl ketone, toluene or the like may be also contained as a solvent.

A thickness of such a dye layer 15 is set to about 1 to 2 μm.

In addition to the dye layers 15*a* (Y), 15*b* (M), and 15*c* (C) of the above three kinds of color types, a black dye layer may be further ordinarily provided. This is because a complete black color image is obtained by overlaying such three colors, since only yellow, magenta, and cyan do not exhibit an ideal reflection spectral characteristics.

A color transfer method actually using such a color sheet 1 according to the present invention will now be described with reference to FIG. 5, whereby the dyes in the color sheet are transferred onto an image receiving sheet 30 as a paper on which an image is to be printed.

As shown in FIG. 5, the image receiving sheet 30 comprising an image receiving base plate 31 and a receptor layer 35 is come into contact with the color sheet 1 in such a manner that the dye layer 15 faces the receptor layer 35. A semiconductor laser 45 built in a printing head 40 emits an optical laser beam having a wavelength in a range of about 780 to 830 nm in such a manner that the near infrared absorbing pigment exhibits the light absorption property, and then the optical laser beam is converged by a lens 43. In this instance, the converged laser beam is irradiated from the side of the substrate 11 of the color sheet 1 to the dye layer 15 through the substrate 11 in the non-contact manner. By the irradiation of the laser beam, the near infrared absorbing pigment contained in the dye layer 15 absorbs the light energy which is converted into the heat energy. The sublimating dye is sublimated by such a heat energy. The sublimated dye is transferred onto the receptor layer 35 of the image receiving sheet 30 (paper on which an image is to be printed) arranged so as to face the dye layer 15. Both of the image receiving sheet 30 and the color sheet 1 are moved at a predetermined speed in association with the movement e.g. rotation of a platen rubber 37.

In the transfer method of the present invention, the sublimated dye is transferred onto the paper in the non-contact manner, because the light beam is used. There is therefore no need to provide any heat resistant lubricating layer on one side of the substrate the other side of which the dye layers are formed on as the conventional.

Actually, the dye layers 15*a* (Y), 15*b* (M), and 15*c* (C) were formed on a substrate made of polyethylene terephthalate having a width of 21 cm as follows: First three ink composition were prepared so that each contains the corresponding sublimating dye of 2.5 weight parts, the near infrared absorbing pigment of 2.5 weight parts, a polyvinyl butyral resin of 5 weight parts as a binder, and methylethyl ketone of 45 weight parts and toluene of 45 weight parts as solvents. Then the three ink composition were coated onto the polyethylene terephthalate substrate in the form of the area sequential type. In addition, a black dye layer containing the near infrared absorbing pigment mentioned above was also separately formed on the substrate. The color sheet 1 formed as mentioned above was abutted onto the image receiving sheet 30 ( a paper on which an image is to be printed) as shown in FIG. 5. After that a semiconductor laser beam having a wavelength of 780 nm and a power of 10 mW was irradiated to the dye layers through the substrate so as to form an image, so that the obtained image was extremely clear. It was confirmed that the printing speed was fairly improved as compared with that in the conventional thermal head system. The printing speed can be further improved by using a color transfer apparatus, which will be explained hereinafter.

Figure 6:
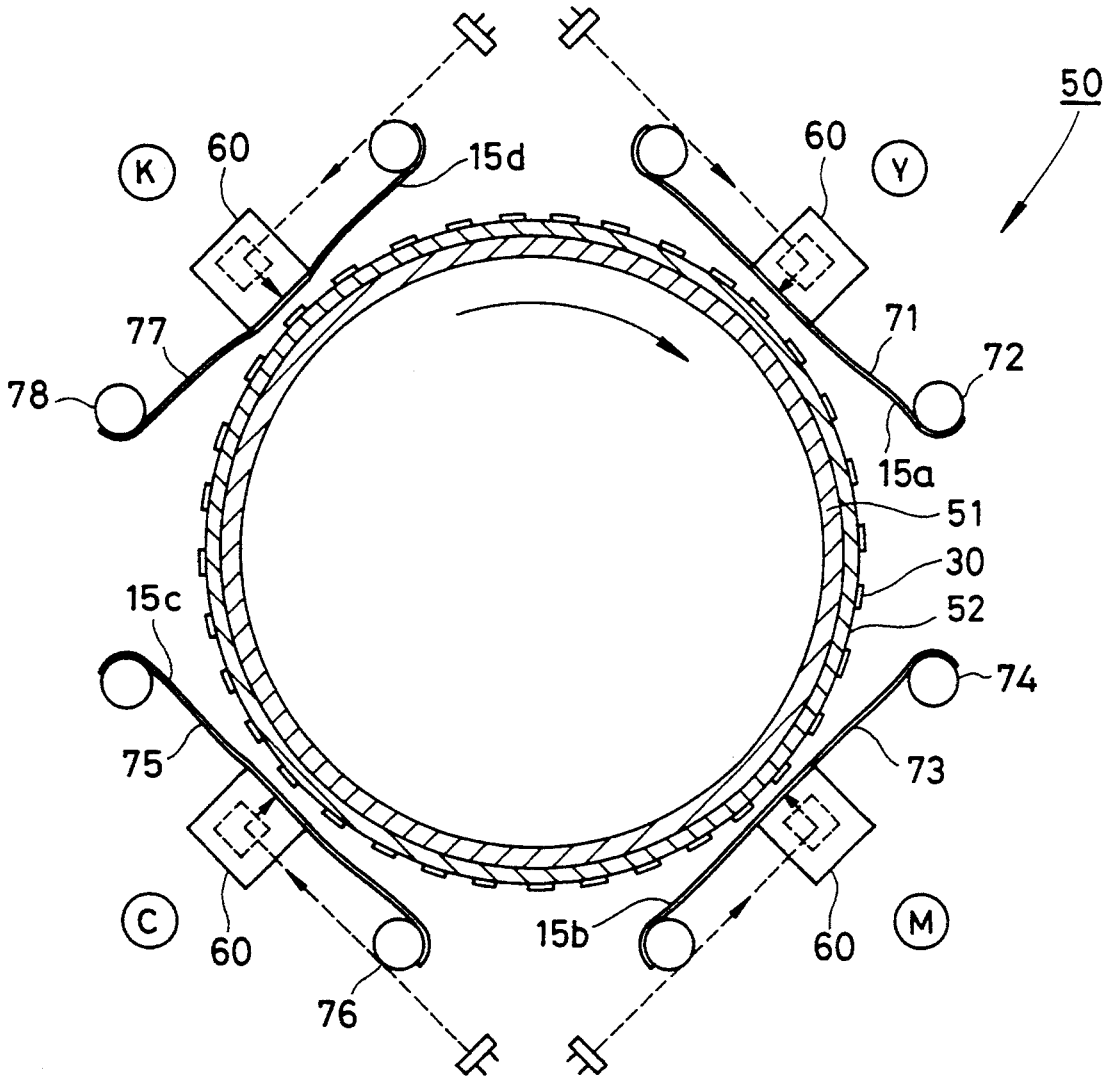
FIG. 6 is a front view showing another example of a preferred color transfer apparatus.
Figure 7:
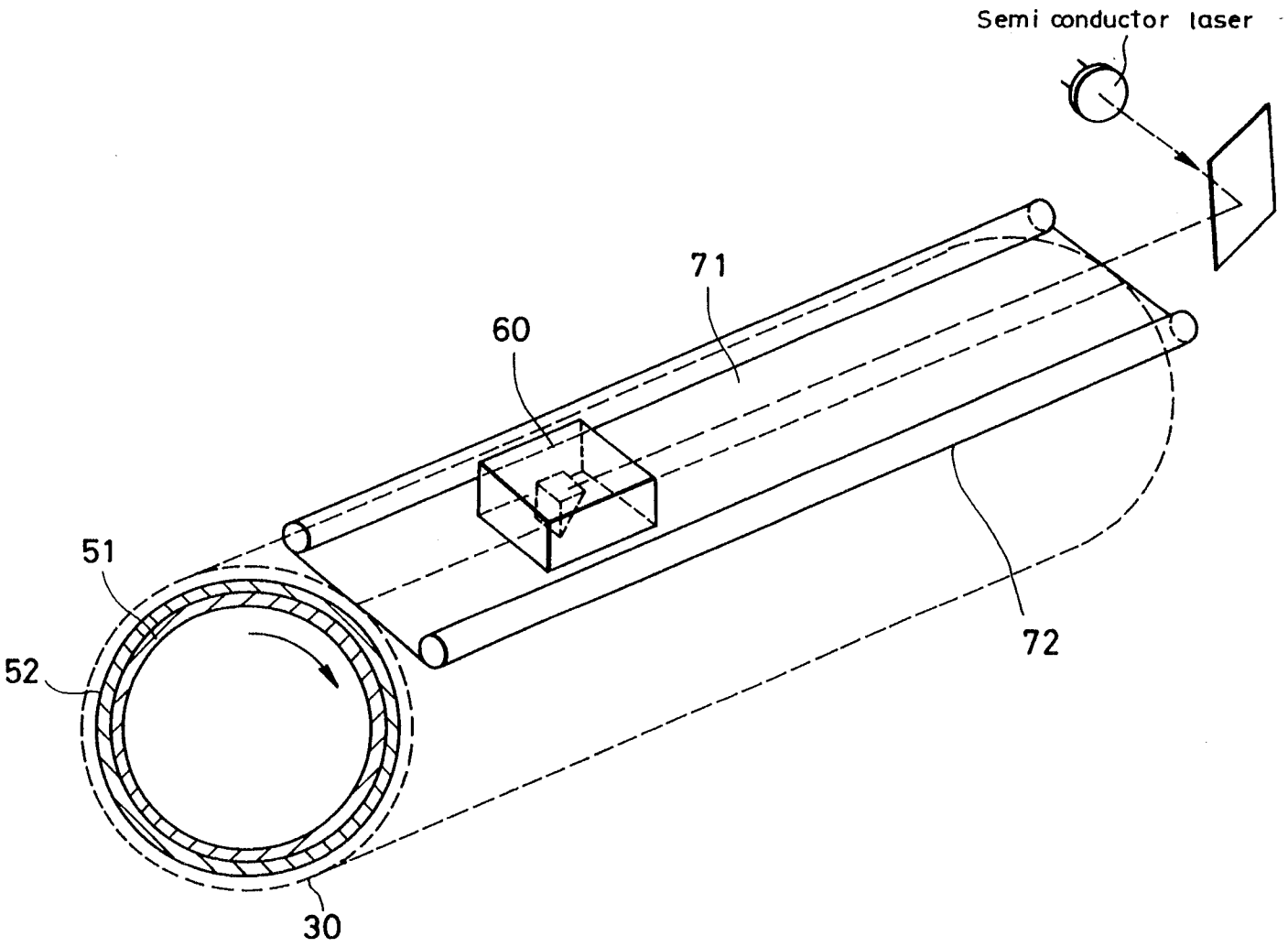
FIG. 7 is a schematic perspective view of one of printing heads shown in FIG. 6.

An another example of a preferred color transfer apparatus will now be described with reference to FIGS. 6 and 7.

A color transfer apparatus 50 comprises: a drum 51; a platen rubber 52 laminated on the circumference of the drum 51; four printing heads 60 arranged on the circumference of the platen rubber 52; and color sheets 71, 73, 75, and 77 arranged at the positions corresponding to the printing heads 60.

The drum 51 has an almost cylindrical shape and its length is properly set in dependence on a width of image receiving sheet 30 (paper on which an image is to be printed) which is used.

A fundamental structure of the printing head 60 is similar to that of the printing head 40 mentioned above. As shown in FIG. 6, the printing head 60 is scanned in the width direction of the drum 51 (paper on which an image is to be printed). With such a structure, there is no need to set a length of head to a value that is almost equal to the width of the paper as in the case where the conventional thermal head is used as heat generating means. In this way, the head structure may be simplified.

The dye layers 15*a* (Y: yellow), 15*b* (M: magenta), 15*c* (C: cyan), and 15*d* (black) of four kinds of types are independently provided for the color sheets 71, 73, 75, and 77, respectively. The foregoing near infrared absorbing pigment is contained in each of the above layers. The color sheets 71, 73, 75, and 77 are enclosed in take-up cassettes 72, 74, 76, and 78, respectively. Each of the color sheets can be sequentially taken out from those cassettes.

By using a structure such that four printing heads 60 are arranged around the drum 51, each image of one special color is transferred onto the paper by each head while continuously rotating the drum 51 in one direction, so that the printing time can be extremely reduced as compared with that of the conventional method of the area sequential type. Since the printing operation is executed by a light beam, further, the scanning speed in the width direction can be raised and the printing time can be further remarkable reduced.

As seen from the mentioned above, the usage of the optical laser beam having a wavelength in the near infrared region within a range of 780 to 830 nm is achieved in the transfer recording or printing, since the near infrared absorbing pigment is contained in the dye layer of the color sheet according to the present invention. Furthermore, the recording speed and the resolution are remarkably improved.

What is claimed is:

1. A color sheet comprising;

a flexible substrate; and a dye layer formed on said substrate made of a mixture of;

at least one sublimating dye and a near infrared absorbing pigment which exhibits a light absorption property for a near infrared region from 760 to 830 nm without exhibiting a substantial light absorption property for a visible wavelength region from 380 to 780 nm, wherein said near infrared absorbing pigment has the following structural formula:

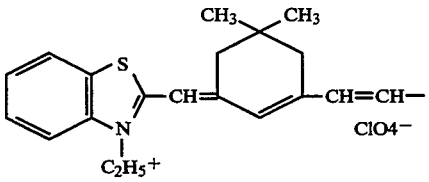

-continued

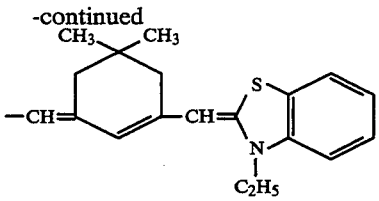

2. A color sheet according to claim 1, wherein said dye layer comprises 2 to 20 parts by weight, more preferably 2 to 10 parts by weight, of the near infrared absorbing pigment.

3. A color sheet according to claim 1, wherein said sublimating dye is a color selected from yellow, magenta and cyan.

4. A color sheet according to claim 1, wherein said dye layer further comprises a binder resin in order to coat the dye layer on the substrate.

5. A color sheet according to claim 4, wherein said binder resin is selected from the group consisting of celluloses, water soluble acryls, polyvinyl alcohol and polyamides.

6. A color transfer method comprising the steps of:

preparing a color sheet comprising a flexible substrate and a dye layer formed on said substrate made of a mixture of at least one sublimating dye and a near infrared absorbing pigment which exhibits a light absorption property for a near infrared region from 760 to 830 nm without exhibiting a substantial light absorption property for a visible wavelength region from 380 to 780 nm wherein said near infrared absorbing pigment has the following structural formula:

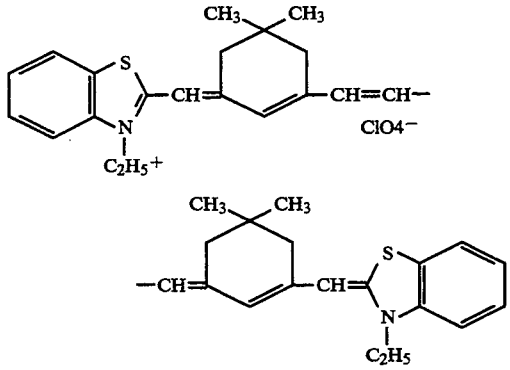

abutting said dye layer of said color sheet onto an image receiving sheet to be printed; and irradiating an optical laser beam to said dye layer, the laser beam consisting of at least one wavelength only within said near infrared region to be absorbed by said near infrared absorbing pigment, whereby light energy absorbed by said near infrared absorbing pigment is converted into heat energy thereby sublimating said sublimating dye and transferring the sublimated dye onto said image receiving sheet arranged so as to face the dye layer.

7. A method according to claim 6, wherein said dye layer comprises 2 to 20 parts by weight, more preferably 2 to 10 parts by weight, of the near infrared absorbing pigment.

8. A method according to claim 6, wherein said sublimating dye is a color selected from yellow, magenta and cyan.

9. A method according to claim 6, wherein said dye layer further comprises a binder resin in order to coat the dye layer on the substrate.

10. A method according to claim 9, wherein said binder resin is selected from the group consisting of celluloses, water soluble acryls, polyvinyl alcohol and polyamides.

* * * * *